US007018250B2

(12) United States Patent
Fuse

(10) Patent No.: US 7,018,250 B2
(45) Date of Patent: Mar. 28, 2006

(54) RIDE PLATE POSITIONING MECHANISM FOR PERSONAL WATERCRAFT, AND METHOD OF USING SAME

(75) Inventor: Tomohiro Fuse, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 101 days.

(21) Appl. No.: 10/660,977

(22) Filed: Sep. 11, 2003

(65) Prior Publication Data

US 2004/0083594 A1 May 6, 2004

(30) Foreign Application Priority Data

Sep. 12, 2002 (JP) ..... 2002-266453

(51) Int. Cl.
*B63H 11/00* (2006.01)
*B63B 35/73* (2006.01)

(52) U.S. Cl. ..... 440/38; 114/55.5; 114/55.57

(58) Field of Classification Search ..... 114/55.5, 114/55.51, 55.56, 55.57, 55.58; 440/37, 440/46, 47, 38; D12/307, 317
See application file for complete search history.

(56) References Cited

U.S. PATENT DOCUMENTS 3,405,526 A * 10/1968 Aschauer ..... 60/221
D317,431 S * 6/1991 Klus ..... D12/317
5,176,548 A * 1/1993 Morgan ..... 440/47
5,369,360 A * 11/1994 Amyot ..... 324/174
D378,813 S * 4/1997 Jacques ..... D12/317
5,619,950 A * 4/1997 Ikeda ..... 114/363
5,700,169 A * 12/1997 Jones ..... 440/46
D392,936 S * 3/1998 Koyanagi ..... D12/317
5,894,087 A * 4/1999 Ohtuka et al. ..... 73/185
6,101,965 A * 8/2000 Koyanagi ..... 114/288
6,213,041 B1 * 4/2001 Kojima et al. ..... 114/55.5
6,544,085 B1 * 4/2003 Ménard et al. ..... 440/88 C

FOREIGN PATENT DOCUMENTS

JP 09281132 A 10/1997
JP 2003089385 A * 3/2003

* cited by examiner

*Primary Examiner*—S. Joseph Morano
*Assistant Examiner*—Ajay Vasudeva
(74) *Attorney, Agent, or Firm*—Carrier, Blackman & Associates, P.C.; William D. Blackman; Joseph P. Carrier

(57) ABSTRACT

A ride plate positioning mechanism for a personal watercraft can reduce the burden on an operator during assembly, and can also raise manufacturing productivity. In a ride plate positioning mechanism 30 of a personal watercraft 10, a portion of a bottom wall 15*a* of a stern 15, that is located below a water jet propeller 17, is formed from a ride plate 31 removable from a craft body 11. Further, a pair of left and right positioning projections 32, 32 are formed integrally on the ride plate 31, while a pair of left and right tab stops 33, 33 corresponding to the positioning projections 32 are provided on the craft body 11 side.

10 Claims, 5 Drawing Sheets

(a)

(b)

RIDE PLATE POSITIONING MECHANISM FOR PERSONAL WATERCRAFT, AND METHOD OF USING SAME

CROSS-REFERENCE TO RELATED APPLICATIONS

The present application claims priority under 35 U.S.C. 119, based on Japanese patent application No. 2002-266453, filed Sep. 12, 2002.

BACKGROUND OF THE INVENTION

1. Field of the Invention

The present invention relates to a ride plate positioning mechanism for a personal watercraft, and to a method of using same. More particularly, the present invention relates to a ride plate positioning mechanism that provides for quick and accurate alignment of a ride plate with an opening portion provided in a bottom face of the watercraft's stem, and to a method of aligning a ride plate with an opening portion of a watercraft, using the described apparatus.

2. Description of the Background Art

A personal watercraft is known as a small size craft that is constructed and arranged to glide on the surface of a sea or lake. Many jet skis and other different types of personal watercraft are known and are commercially available. One example of a personal watercraft is described in Japanese Laid-Open Patent No. Hei 9-281132.

The personal watercraft described in this reference includes an engine and a jet propeller driven by the engine, both provided in a craft body, and also includes a steering nozzle at a rear end of the jet propeller. According to the personal watercraft, the jet propeller is driven by the engine to rotate an impeller of the water jet propeller, so that water is taken in through an inlet port of the craft bottom by the rotation of the impeller.

The water taken in is expelled rearwardly, as exhaust jet water from the rear end of the steering nozzle, so that the personal watercraft can be moved forward by the jetting force of the jet water.

A portion of the bottom face that forms the stern of the personal watercraft, below the water jet propeller, is formed by a ride plate, which is removable from the craft body. Since the ride plate is attached to the craft bottom, water can flow smoothly rearward along the ride plate.

Here, in order to reduce the resistance of the craft body against propulsion, and to allow the personal watercraft to glide favorably, it is necessary to accurately align and set the orientation of the ride plate, in the forward and rearward direction, on the craft body.

The ride plate is normally attached to the craft body by means of bolts, taking into consideration the ease of assembly to the craft body and the convenient disassembly for maintenance.

For example, the ride plate may be formed as a substantially rectangular plate, with attaching holes formed at four locations thereon, including left and right side portions of a front portion of the rectangular plate, and left and right side portions of a rear portion of the rectangular plate.

Meanwhile, threaded holes are formed at four locations on the bottom of the craft body, corresponding to the attaching holes of the ride plate.

In order to attach the ride plate to the craft bottom, the four attaching holes of the ride plate are aligned with the four threaded holes of the craft body. Then, bolts are inserted into the four attaching holes, and the bolts thus inserted are screwed into the threaded holes. Accordingly, the ride plate can be attached to the craft bottom of the craft body.

However, where bolts are used for fastening the ride plate, it is difficult to attach the ride plate to the craft body quickly and with a high degree of accuracy, due to an influence of the tolerance of the attaching holes or the bolts.

Particularly, it is difficult to assemble the ride plate to the craft body with a high degree of accuracy in regard to the orientation in the forward and backward direction. If it is tried to raise the accuracy in assembly, then more time is required for the assembly of the ride plate to the craft body, which makes an obstacle to improvement in the productivity.

Therefore, it is an object of the present invention to provide a ride plate positioning mechanism for a personal watercraft that can simply raise the alignment accuracy, in assembly, of a ride plate to a craft body.

SUMMARY OF THE INVENTION

In order to achieve the object described above, a ride plate positioning mechanism is provided for a personal watercraft having an engine and a jet propeller driven by the engine. The engine and jet propeller are situated in a craft body such that the personal watercraft is capable of being propelled by jet water generated by the jet propeller.

A ride plate positioning mechanism according to the invention includes a removable ride plate, which forms a portion of a bottom face of a stem of the craft body, below the jet propeller. The ride plate has a pair of integrally formed left and right positioning projections projecting upwardly at a front portion thereof.

The bottom face of the stem of the craft body has a pair of left and right tab stops formed therein, for contacting front faces of the positioning projections of the ride plate.

The pair of left and right positioning projections are integrally formed on the ride plate, and the pair of left and right tab stops, corresponding to the left and right positioning projections, are provided on the craft body side. Consequently, if the positioning projections of the ride plate are brought into contact with the tab stops on the craft body side, then the ride plate can be assembled to the craft body quickly and with a high degree of accuracy, particularly in regard to the orientation in the forward and rearward direction.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

Figure 1:
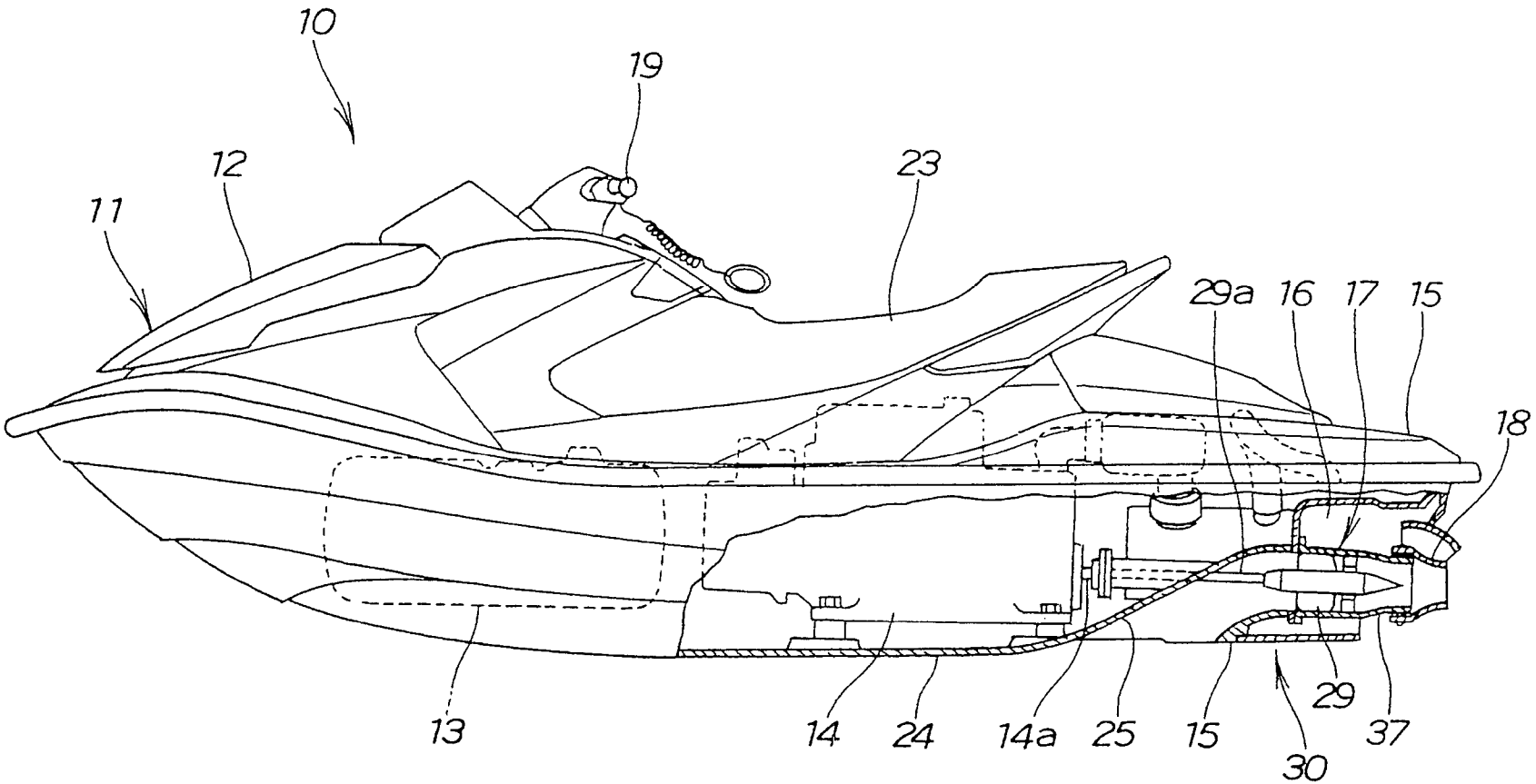
FIG. 1 is a side elevational view showing a personal watercraft that includes a ride plate positioning mechanism according to a selected illustrative embodiment of the present invention.

In the following, an embodiment of the present invention is described with reference to the accompanying drawings. Here, the terms "front", "rear", "left" and "right" represent directions as viewed from the vantage point of a driver. It is to be noted that the drawings should be viewed in the direction of reference characters.

FIG. 1 is a side elevational view of a personal watercraft that includes a ride plate positioning mechanism according to a selected illustrative embodiment of the present invention.

A personal watercraft 10 includes a fuel tank 13 provided at a front portion 12 of a craft body 11. An engine 14 is provided rearward of the fuel tank 13. A jet propeller chamber 16 is provided at a stern 15 rearward of the engine 14. A water jet propeller (jet propeller) 17 is provided in the jet propeller chamber 16. A steering nozzle 18 is provided rearward of the water jet propeller 17. A steering handle member 19 for swinging the steering nozzle 18 leftwardly and rightwardly is provided above the fuel tank 13. A seat 23 is provided in back of the steering handle member 19, such that it extends in a forward and rearward direction.

A ride plate positioning mechanism 30, according to a selected illustrative embodiment of the present invention, is provided on a bottom face of the stern 15, below and behind the seat 21.

Figure 2:
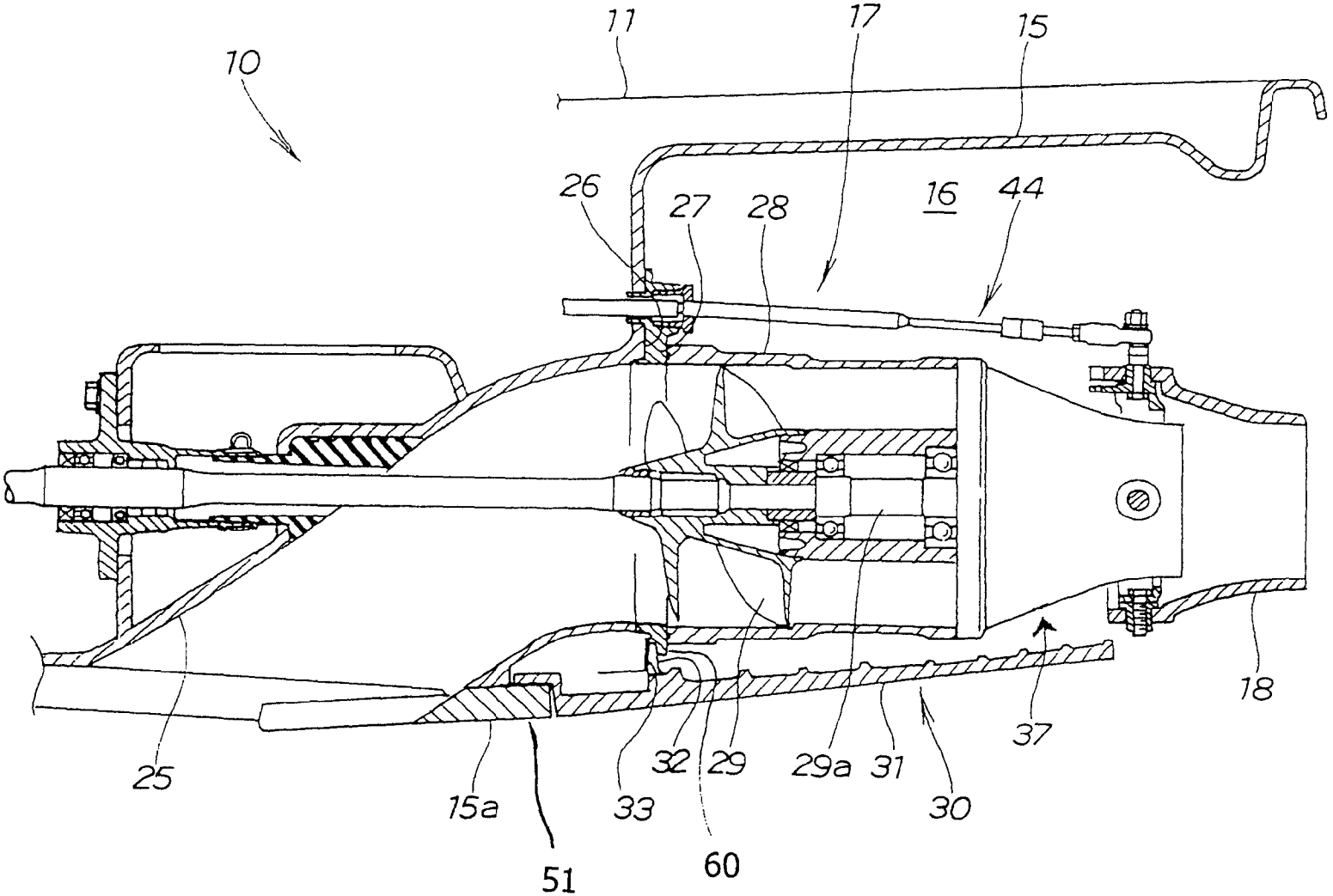
FIG. 2 is a sectional detail view of an essential part of the personal watercraft of FIG. 1, showing a drive mechanism that includes a steering nozzle attachment structure according to the present invention.

FIG. 2 sectional detail view of an essential part of the personal watercraft of FIG. 1, showing a drive mechanism that includes a steering nozzle attachment structure, according to the selected embodiment of the present invention.

The water jet propeller 17 includes an inlet port 25 formed in a craft bottom 24 (refer to FIG. 1) of the craft body 11. The inlet port 25 extends to the jet propeller chamber 16. A base 27 is provided in close proximity to a transverse vertical wall portion 26 of the jet propeller chamber 16. A cylindrical stator 28 is provided on the base 27. As shown in the drawing, a lowermost portion of the base 27 forms a dependent ridge 60, which extends a short distance downwardly from the bottom of the stator 28. An impeller 29 is disposed for rotation in the stator 28. A drive shaft 14*a* (refer to FIG. 1) is connected a shaft 29*a* of the impeller 29.

With the personal watercraft 10, the drive shaft 14*a* can be rotated by the engine 14 shown in FIG. 1 to rotate the impeller 29. By the rotation of the impeller 29, water can be taken in through the inlet port 25 and introduced into the stator 28.

The water introduced is jetted rearward as a water jet from the rear end of the stator 28 through the steering nozzle 18, so that the personal watercraft 10 can glide forward.

In the ride plate positioning mechanism 30 of the personal watercraft 10, a portion of a bottom wall 15*a* of the stern 15 below the water jet propeller 17 is formed by a ride plate 31, which is removable from the craft body 11. Further, a pair of left and right positioning projections 32, 32 are formed integrally on the ride plate 31 while a pair of left and right tab stops 33, 33 corresponding to the left and right positioning projections 32, 32 are provided on the craft body 11 side.

The left and right positioning projections 32, 32 can be contacted with the left and right tab stops 33, 33 to attach the ride plate 31 to the craft body 11 with a high degree of accuracy in the forward and rearward direction.

Figure 3:
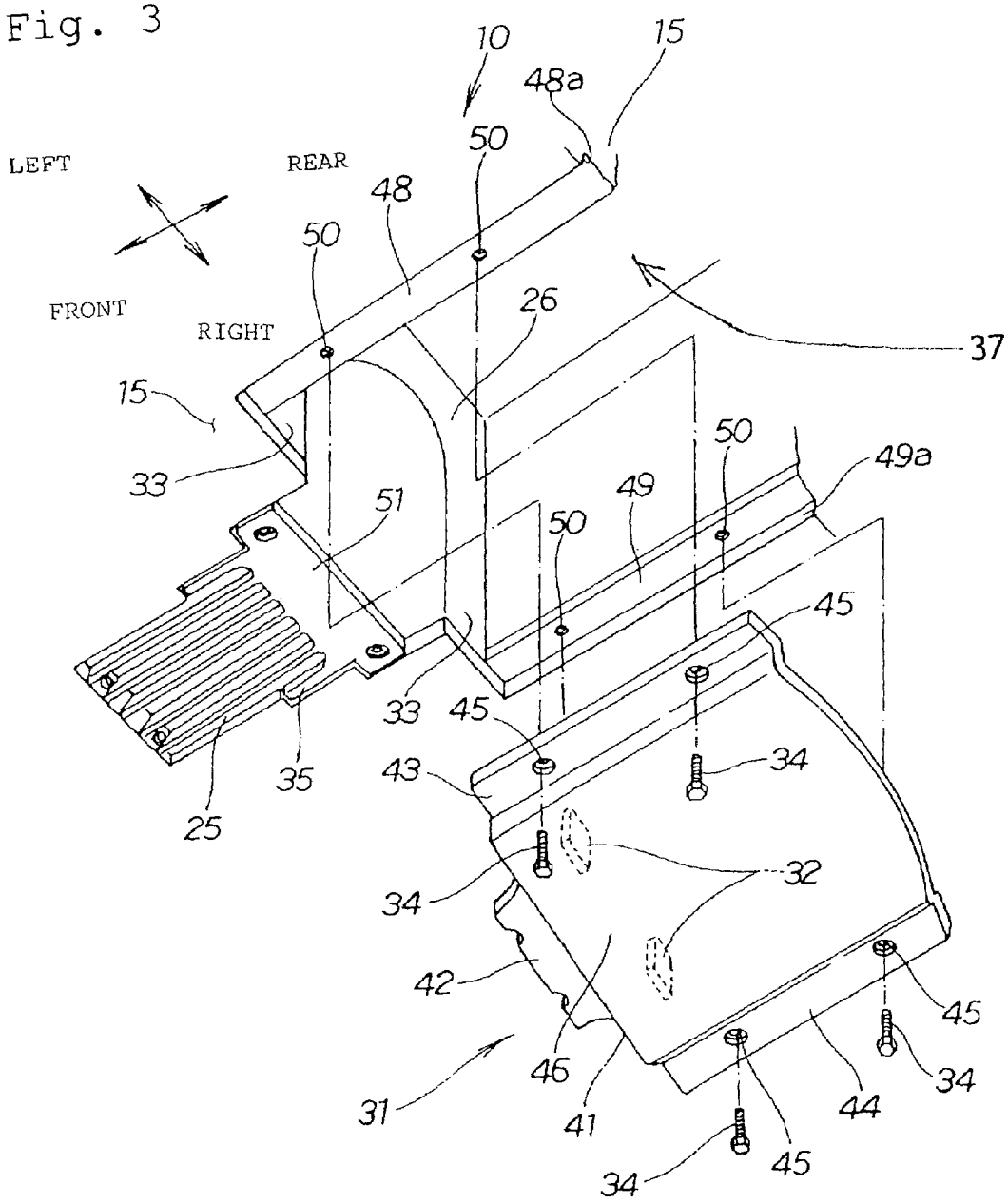
FIG. 3 is an exploded perspective view showing the ride plate positioning mechanism for a personal watercraft according to the selected embodiment of the present invention.

The ride plate 31 is secured to the craft body 11 by means of bolts 34 (FIG. 3).

FIG. 3 is an exploded perspective view showing the ride plate positioning mechanism for a personal watercraft according to an illustrative embodiment of the present invention. FIG. 3 shows a state wherein part of the inlet port 25 of the water jet propeller 17 (FIG. 2) is formed in the bottom wall 15*a* of the stern 15, and a grating member 35 is secured to the inlet port 25 by means of bolts.

The ride plate 31 is formed in a substantially rectangular shape, in a corresponding relationship to an opening portion 37 of the bottom wall 15*a*. The ride plate 31 has an elevated arresting piece 42 provided at a front edge 41 thereof, and also has attaching holes 45 formed in left and right side portions 43, 44 thereof, respectively. Further, a pair of left and right positioning projections 32, 32 are provided in a predetermined spaced relationship from each other on an top inner surface 47 (refer to FIG. 4) of a front end portion 46 of the ride plate 31. In the installed configuration of the ride plate 31, the top inner surface 47 of the front end portion 46 is situated opposite and facing towards the craft body 11.

Meanwhile, the opening portion 37 of the bottom wall 15*a* includes left and right recessed receiving portions 48, 49 provided on left and right side portions thereof for receiving the left and right side portions 43, 44 of the ride plate 31 respectively. Threaded holes 50 are provided at front and rear portions of the left and right recessed receiving portions 48, 49.

Left and right stepped portions 48*a*, 49*a* can be formed by providing the left and right recessed receiving portions 48, 49 at the opening portion 37 of the bottom wall 15*a* in this manner.

Consequently, since the location of the left and right side portions 43, 44 of the ride plate 31 can be controlled by the left and right stepped portions 48*a*, 49*a*, respectively, positioning of the ride plate 31 in the leftward and rightward direction can be easily achieved.

It is to be noted that the threaded holes 50, provided in the left and right recessed receiving portions 48, 49 are formed at positions of the ride plate 31 which correspond to the attaching holes 45.

Further, the transverse vertical wall face 26 of the craft body 11 includes the pair of left and right tab stops 33, 33 corresponding to the left and right positioning projections 32, 32.

The elevated arresting piece 42 of the ride plate 31 is placed over a rear end portion 51 of the grating member 35, and the ride plate is slid forwardly until the left and right positioning projections 32, 32 contact the left and right tab stops 33, 33. In this state, the left and right side portions 43, 44 of the ride plate 31 are pressed against the left and right recessed receiving portions 48, 49, respectively.

At this time, the left and right side portions 43, 44 of the ride plate 31 can be aligned with the left and right stepped portions 48*a*, 49*a*, which form the left and right recessed receiving portions 48, 49, respectively. Consequently, the ride plate 31 can be positioned in the leftward and rightward direction by the left and right stepped portions 48*a*, 49*a*, respectively.

Consequently, the attaching holes 45 can be aligned with the threaded holes 50. The ride plate 31 can then be attached to the bottom wall 15*a* by inserting the bolts 34 into the attaching holes 45, and screwing the inserted bolts 34 into the threaded holes 50.

The pair of left and right positioning projections 32, 32 are integrally formed on the ride plate 31, and the pair of left and right tab stops 33, 33, corresponding to the left and right positioning projections 32, 32, are provided on the craft body 11 side.

Consequently, only if the left and right positioning projections 32, 32 of the ride plate 31 are brought into contact with the left and right tab stops 33, 33 on the craft body 11 side, the ride plate 31 can be assembled to the craft body 11 quickly and with a high degree of accuracy.

As a result, the ride plate 31 can be assembled to the craft body simply with a high degree of accuracy without requiring much time.

Figure 4:
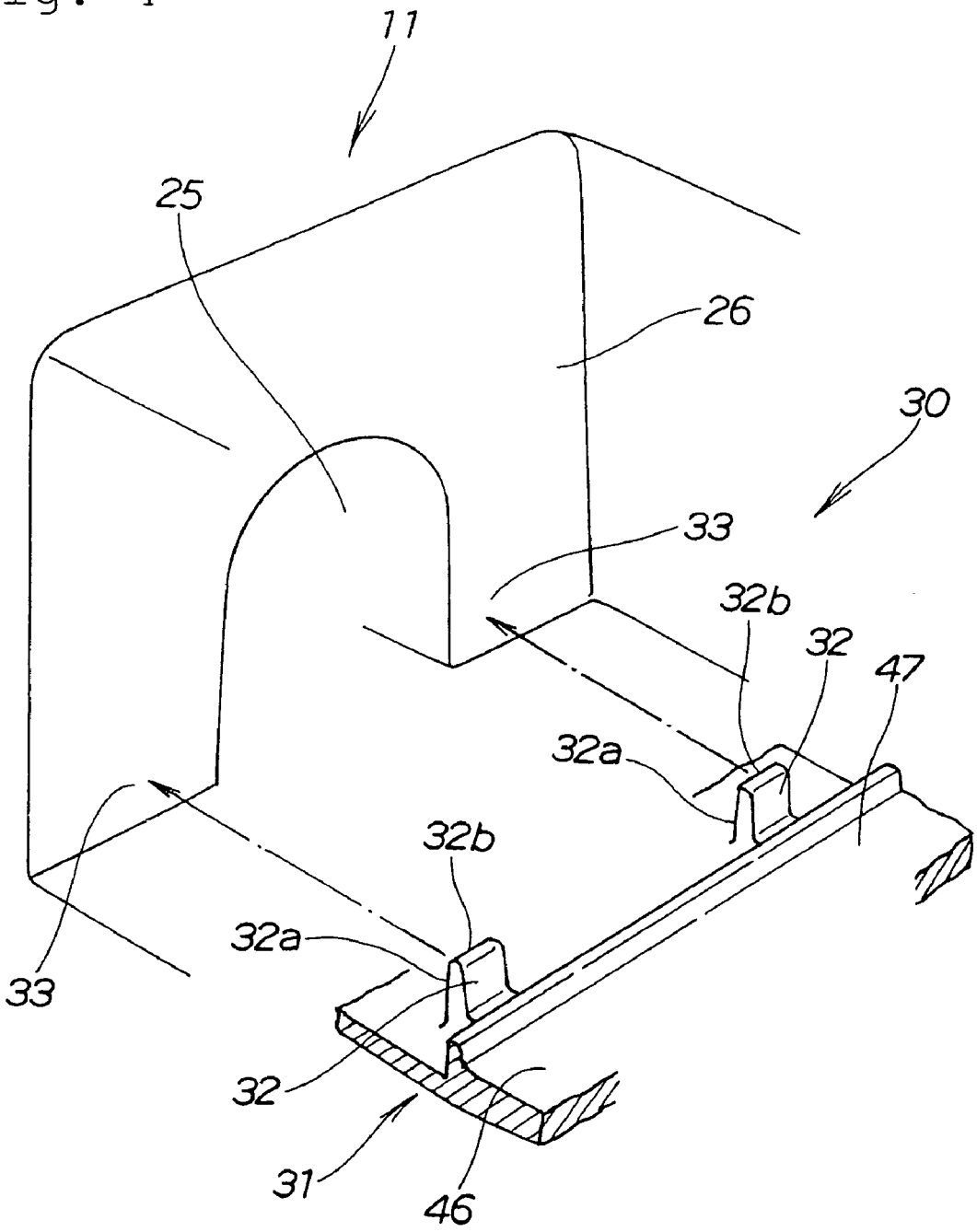
FIG. 4 is an exploded perspective view showing an essential part of the ride plate positioning mechanism for a personal watercraft according to the selected embodiment of the present invention.

FIG. 4 is an exploded view showing an essential part of the ride plate positioning mechanism for a personal watercraft according to the present invention.

A portion of the bottom wall 15*a* of the stern 15 below the water jet propeller 17 is formed by the ride plate 31, which is made to be removable from the craft body 11. The pair of left and right positioning projections 32, 32 are formed integrally on the top inner surface 47 of the front end portion 46 of the ride plate 31. The pair of left and right tab stops 33, 33, corresponding to the left and right positioning projections 32, 32, are provided on the transverse vertical wall face 26 of the craft body 11.

The pair of left and right positioning projections 32, 32 are members which project upward in a predetermined spaced relationship from each other from the upper surface 47 of the front end portion 46 which forms the ride plate 31. The projecting portions 32, 32 are each formed so as to have a substantially rectangular shape in horizontal section, while the front end portions 32*a*, 32*a* thereof are flattened and situated in substantially vertical planes, and are provided to contact the left and right tab stops 33, 33.

It is to be noted that it is otherwise possible to dispose the left and right positioning projections 32, 32 in a forward inclined state such that the tip ends 32*b*, 32*b* thereof are constructed and arranged to make contact with the left and right tab stops 33, 33.

In the depicted embodiment, the transverse vertical wall face 26 of the craft body 11 is utilized to define the left and right tab stops 33, 33.

Consequently, there is no necessity to separately form the tab stops 33, 33 on the craft body 11 side, and as a result, the ride plate positioning mechanism 30 for a personal watercraft can be formed with a simple configuration.

Subsequently, an example wherein the ride plate 31 that includes part of the ride plate positioning mechanism 30 is assembled to the opening portion 37 of the craft body 11 is described with reference to FIG. 5.

Figure 5:
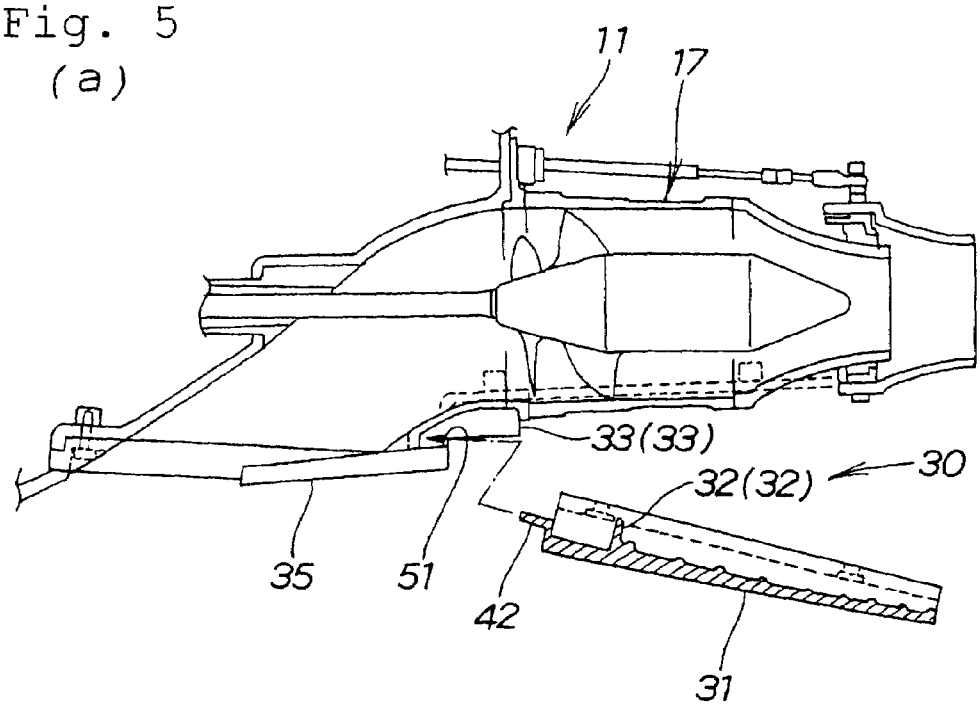
FIG. 5 is a schematic view illustrating two stages in a procedure of assembling a ride plate, which includes part of the ride plate positioning mechanism for a personal watercraft according to the present invention, to a craft body.
Figure 5:
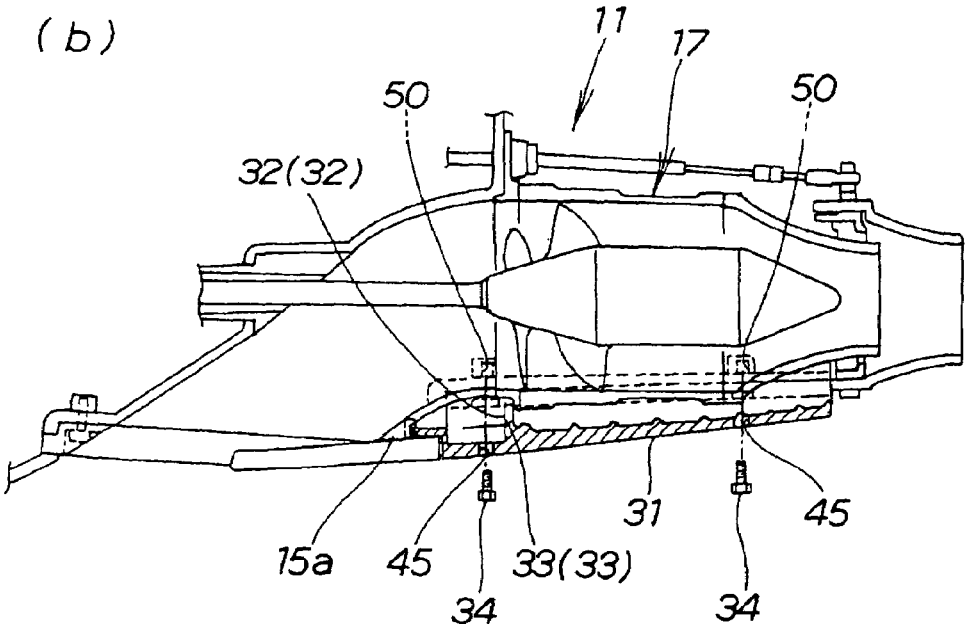

FIGS. 5(*a*) and (*b*) are schematic views illustrating a procedure of assembling the ride plate, which includes part of the ride plate positioning mechanism for a personal watercraft according to the present invention, to the craft body.

Referring to (a) of FIG. 5, the elevated arresting piece 42 of the ride plate 31 is placed over the rear end portion 51 of the grating member 35, as indicated by an arrow mark.

Referring to (b) of FIG. 5, the ride plate 31 is then slid forward until the left and right positioning projections 32, 32 thereof are brought into contact with the left and right tab stops 33, 33 on the craft body 11 side. The ride plate 31 is then pivoted upwardly, around the back edge of the grating member 35, until the positioning projections 32, 32 are nested between the tab stops 33, 33 and the dependent ridge 60, as shown. In this state, the left and right side portions 43, 44 of the ride plate 31 are aligned with, and pressed against the left and right recessed receiving portions 48, 49, respectively (refer to FIG. 3).

Consequently, the attaching holes 45 are aligned with the threaded holes 50. The bolts 34 are inserted into the attaching holes 45, and the bolts 34, thus inserted, are screwed into the threaded holes 50. Accordingly, the ride plate 31 can be attached to the bottom wall 15*a*.

When the left and right positioning projections 32, 32 of the ride plate 31 contact the left and right tab stops 33, 33 on the craft body 11 side in this manner, the ride plate 31 can be attached to the craft body 11 quickly and with a high degree of accuracy, particularly in regard to the orientation in the forward and rearward direction.

It is to be noted that, in the embodiment described above, the transverse vertical wall face 26 is utilized to define the tab stops 33, 33 for the positioning projections 32, 32. However, it is otherwise possible to form recessed portions in the transverse vertical wall portion 26, and to use the locations of the recessed portions as the left and right tab stops 33, 33.

Accordingly, positioning of the ride plate in the leftward and rightward direction can be performed simply while requiring reduced time.

Further, in the embodiment described above, the left and right positioning projections 32, 32 are formed so that they project from the top inner surface 47 of the front end portion 46 of the ride plate 31, and have a substantially rectangular cross-sectional shape. However, the sectional shape of the positioning projections 32, 32 is not limited to this, but any shape may be selected.

The present invention exhibits the following effects due to the configuration described above.

The left and right positioning projections are integrally formed on the ride plate, and the left and right tab stops corresponding to the left and right positioning projections are provided on the craft body side. Consequently, if the positioning projections of the ride plate are brought into contact with the tab stops on the craft body side, then the ride plate can be assembled to the craft body quickly and with a high degree of accuracy, particularly in regard to the orientation in the forward and rearward direction with respect to the craft body.

Since the ride plate can be assembled to the craft body with a high degree of accuracy only by contacting the left and right positioning projections of the ride plate with the left and right tab stops on the craft body side in this manner, productivity during assembly can be raised.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

What is claimed is:

1. A ride plate positioning mechanism for a personal watercraft having a craft body, an engine and a jet propeller driven by said engine, such that said personal watercraft is capable of being propelled by jet water generated by said jet propeller, said ride plate positioning mechanism comprising:

a removable ride plate for defining a bottom portion of a stern of said craft body, said ride plate comprising a pair of integrally formed left and right positioning projections projecting upwardly at a front portion of said ride plate, said positioning projections having vertically oriented front faces for contacting said craft body; and a pair of left and right tab stops formed in a hull of said craft body of said watercraft, said pair of tab stops contacting the vertically oriented front faces of said positioning projections when the ride plate is installed on said craft body.

2. The ride plate positioning mechanism of claim 1, wherein the ride plate further comprises an elevated arresting member extending outwardly at the front end thereof, for stabilizing placement on a support piece.

3. The ride plate positioning mechanism of claim 2, wherein the elevated arresting member is narrower than the widest part of said ride plate.

4. The ride plate positioning mechanism of claim 1, wherein said craft body comprises a stator and a dependent ridge which extends downwardly adjacent said stator, and wherein said positioning projections fit nestingly between said tab stops and said dependent ridge.

5. The ride plate positioning mechanism of claim 1, wherein said ride plate includes side edge portions which are raised up in relation to adjoining portions of said ride plate.

6. The ride plate positioning mechanism of claim 5, wherein said craft body has an opening formed in said bottom portion of said stern with a pair of shallow, spaced apart stepped recesses formed at the sides of said opening to receive said side edge portions of said ride plate.

7. The ride plate positioning mechanism of claim 1 , wherein said positioning projections have flattened front faces.

8. The ride plate positioning mechanism of claim 1, wherein said positioning projections are constructed and arranged to have a substantially rectangular horizontal cross-sectional shape.

9. The ride plate positioning mechanism of claim 1, wherein said ride plate further comprises at least one raised rib extending transversely across an upper surface thereof behind said positioning projections.

10. The ride plate positioning mechanism of claim 9, wherein said ride plate has a plurality of spaced-apart raised ribs on said upper surface thereof.

* * * * *